United States Patent [19]

Steinhauer et al.

[11] 4,289,644

[45] Sep. 15, 1981

[54] PRE-WASH STICK CLEANER

[75] Inventors: Roger C. Steinhauer, Park Forest; Isabelle M. Gabriel, Chicago, both of Ill.

[73] Assignee: Armour-Dial, Inc., Phoenix, Ariz.

[21] Appl. No.: 156,324

[22] Filed: Jun. 4, 1980

Related U.S. Application Data

[63] Continuation-in-part of Ser. No. 941,829, Sep. 11, 1978, abandoned.

[51] Int. Cl.[3] ..... C11D 50/00; C11D 9/26; C11D 17/00

[52] U.S. Cl. ..... 252/127; 252/108; 252/122; 252/126; 252/132; 252/134; 252/170; 252/174; 252/174.21

[58] Field of Search ..... 252/90, 118, 122, 126, 252/127, 132, 134, 170, 171, 174, DIG. 1

[56] References Cited

U.S. PATENT DOCUMENTS

| | | | |
|---|---|---|---|
| 2,084,632 | 6/1937 | Ellis | 252/126 |
| 2,093,824 | 9/1937 | Woronoff | 252/126 |
| 2,143,066 | 1/1939 | Hampton | 252/126 |
| 3,155,624 | 11/1964 | Kelly | 252/122 |
| 3,417,023 | 12/1968 | DiSalvo et al. | 252/118 |
| 3,664,962 | 5/1972 | Kelly et al. | 252/118 |
| 3,686,125 | 8/1972 | Miller | 252/99 |
| 3,714,049 | 1/1973 | Charle et al. | 252/90 |
| 3,808,144 | 4/1974 | Raley | 252/105 |
| 3,872,021 | 3/1975 | McKnight | 252/121 |
| 3,975,313 | 8/1976 | Shelmire | 252/542 |

FOREIGN PATENT DOCUMENTS

| | | |
|---|---|---|
| 971456 | 7/1975 | Canada . |
| 2300838 | 10/1976 | France . |
| 49-78707 | 7/1974 | Japan . |
| 50-110404 | 8/1975 | Japan . |
| 51-6203 | 1/1976 | Japan . |
| 1397475 | 6/1975 | United Kingdom . |

OTHER PUBLICATIONS

Bennett, H., "The Chemical Formulary," Chemical Publishing Co., N. Y., vol. XIX, 1976, p. 248.

Emulsions & Detergents, Carbide & Carbon Chemicals Corp. (Union Carbide), Eighth Ed., p. 64.

*Primary Examiner*—P. E. Willis, Jr.

*Attorney, Agent, or Firm*—Frank T. Barber; Charles E. Cates; Richard G. Harrer

[57] ABSTRACT

A solid, non-thixotropic pre-wash cleaner is disclosed. Its ingredients are a balanced system of selected paraffinic hydrocarbon solvents and nonionic synthetic detergents, tallow soap and sorbitol. The sorbitol binds the composition into a solid mass suitable for forming into a soap stick. Sodium thiosulfate, perfume and color are optional ingredients and may be added for preservation and aesthetic enhancement.

7 Claims, No Drawings

PRE-WASH STICK CLEANER

BACKGROUND OF THE INVENTION

This is a continuation-in-part of co-pending patent application Ser. No. 941,829, filed Sept. 11, 1978, now abandoned.

This invention relates to pre-wash cleaners, particularly to pre-wash cleaners incorporating hydrocarbons and soap.

Pre-wash cleaners are an important part of the home laundry art where they are used to extract tough stains. If the product is to be effective against a wide variety of stains, soap and hydrocarbons are the ingredients of choice; however, they have not heretofore been successfully made into a stick product because they separate when combined, typically into a curdy whey exhibiting the appearance of buttermilk, or the product is thixotropic. Aesthetically, the appearance is unacceptable to the end user of the product, even though the product is efficacious.

To avoid the problems inherent in combining soap and hydrocarbon cleaning agents, the prior art workers have found it necessary to present the product in the form of a liquid which can be shaken up and applied as an emulsion, or an aerosol, both of which lend themselves well to disguising the separation of the active ingredients.

However, a hard stick form would be more convenient and economical than either the aerosol or the liquid forms. The user of a stick can deposit the cleaning product on the material to be cleaned more precisely and with less waste, and a stick form is a more convenient size and shape to handle. Moreover, there are inherent packaging and safety problems associated with aerosol and liquid products, and there are extra packaging and shipping expenses caused by the bulk and weight of the aerosol or water.

Thus, there has been a felt need and desire for such a solid stick product. However, no means of coupling the soap and hydrocarbon solvents was known (until the making of this invention) that would keep the ingredients in solid stick form both during storage and use.

Brief Description of the Invention

It has now been discovered that a pre-wash cleaner in stick form can be successfully made by combining a system of paraffinic hydrocarbon solvents and nonionic detergents (having an oil/water solubility about the range defined by 3 ethylene oxide units) with tallow soap, using sorbitol as a coupling agent. In a typical preferred composition the nonionic surfactant/hydrocarbon solvent system comprises about 70 weight percent of the composition, the soap and the sorbitol each comprise about 15 weight percent.

The hydrocarbon/detergent system must be balanced. In the case of the 80–20 mixture the hydrophobic moiety of the detergent has an average of 15 carbon atoms in the chain and an ethylene oxide equivalent of 3. Making such balanced mixtures is known to persons ordinarily skilled in the art. For example, a commercial preparation for spotting stains sold under the trade name UCAR 5076 made by Union Carbide Corporation is a suitable system of hydrocarbons and synthetic nonionic detergent and is a recommended ingredient.

In another preferred composition paraffinic hydrocarbons are combined with a nonionic synthetic detergent in the weight ratio of about 80:20 which system comprises about 70 weight percent of the product composition, tallow soap and sorbitol each comprise about 15 percent. Conveniently, the foregoing compositions may be enhanced for end user acceptability by the addition of small amounts of perfume and dye. An anti-oxidant such as sodium thiosulfate is useful in such a composition as a preservative.

Preferably, the perfume, dye and preservative comprise about 0.05, 0.004 and 0.1 weight percent respectively of the total composition.

Broadly, the term soap as used herein may be understood to include any salt of a higher fatty acid commonly known as soap that is comparable to tallow soap which produces a stick of superior strength. Tallow soap as defined may include other fatty acid components having from 12–15 carbon atoms in the chain, but not more than a ratio equal to about 85/15 (tallow-/other) soap.

Paraffinic solvents may be straight and branch chain, with predominantly 9 carbon atoms in the chain. A preferred paraffin has a boiling point of 300°±5° F., a dry point of 350°±5° F., an average molecular weight of about 143. Such can be obtained from Shell Chemical Company under the name Shell Sol 70.

Other straight and branch chain aliphatic and alicyclic compounds known to be usable in the laundry and dry cleaning art may be included in amounts that do not change the basic character of the above paraffins, but aromatics should be small enough for odor control and prevention of benzene contamination.

The term nonionic detergents broadly includes all such detergents as are commonly understood to be embraced in the term and useful in the laundry/dry cleaning arts. For example, but not by way of limitation, the term includes ethoxylated alcohols, phenylalcohols, mercaptan alkylene oxide condensates. A suitable nonionic detergent is Tergitol 15-5-3 (obtainable from Union Carbide Corporation) whose carbon chain length is 15 and which has a secondary alcohol and the equivalent of 3 ethylene oxide units.

Detailed Description of the Preferred Embodiments

A typical product according to this invention was made as follows:

EXAMPLE I

Method of Preparation

The soap and sorbitol are melted together in a suitable hot water or steam jacketed vessel at a temperature of 47°±2 C. Agitation of the mixture is initiated when the soap melts to the point where the mixture becomes fluid. From this point until the product is completely formulated the batch is kept under constant agitation. A thick milky emulsion is formed when the soap and sorbitol are thoroughly mixed. The paraffinic hydrocarbon solvent is then added slowly during which a clear viscous melt is formed. The sodium thiosulfate is next added allowing 10–15 minutes stirring time to effect solublization before the next component is added. Finally, the dye and perfume are added in sequence. The molten product is then poured into a suitable packaging container and allowed to cool to room temperature.

The resulting product had the following composition:

| Components (by weight) | Percent of Total Composition |
|---|---|
| Ucar 5076 Pre-Wash Spotter Solvent (80% H.C. - 20% nonionic detergent) | 69.846 |
| Sorbitol, 70% Solution | 15.000 |
| Tallow soap | 15.000 |
| Sodium Thiosulfate | 0.100 |
| ADI Perfume #2406 | 0.050 |
| Sudan Blue CSP (C.I. 61525) | 0.004 |

The product was a clear to translucent, extrudable stick at ambient temperatures.

Further examples illustrating the presently preferred embodiments of the invention prepared by the method of Example I are as follows:

EXAMPLE II

| Components (by weight) | Percent of Total Composition |
|---|---|
| Paraffinic Hydrocarbon Solvent (Shell Sol 70) | 65.469 |
| Alcohol Ethoxylate (Tergitol 15-5-3) | 4.179 |
| Sorbitol, 70% Solution | 15.000 |
| Tallow Soap | 15.000 |
| Sodium Thiosulfate | 0.150 |
| Perfume | 0.200 |
| Sudan Blue 6A | 0.002 |

EXAMPLE III

| Components (by weight) | Percent of Total Composition |
|---|---|
| Paraffinic Hydrocarbon Solvent | 65.469 |
| Alcohol Ethoxylate | 4.179 |
| Sorbitol, 70% | 15.000 |
| Tallow/Coconut Soap Blend (85/15) | 15.000 |
| Sodium Thiosulfate | 0.150 |
| Perfume | 0.200 |
| Sudan Blue 6A | 0.002 |

TESTING OF PRODUCT

The performance of a typical product such as described in Example I was compared with a well-known brand of aerosol pre-wash for performance efficacy in tests conducted according to the following protocol:

The fabric stain removal efficacy was determined by the following test protocol: eight standard stains were used on each swatch: grape juice, motor oil, mustard, sebum, crayon, lipstick, salad dressing and ball point pen ink. Each of the stained fabric swatches was washed in a Tergotometer beaker with either product and detergent or with detergent alone. Swatches were graded for stain removal efficiency on a 0 (no stain removal) to 10 (complete stain removal) scale for each of 8 (80=complete stain removal of all stains) stains. Results were reported as percent stain removal; for example, a 70% stain removal represents a stain removal score of 56 (i.e., $56/80 \times 100\% = 70\%$). Leading detergents were used as controls: Tide in hot water and Cold Power in cold water (both 8.7% phosphorus) being the selections.

In the table below an average rating of the product removal efficacy against eight common stains were made, the higher rating indicating the greater efficacy. The data in column A resulted from washing stained swatches of material in 120° F. tap water with Tide (8.7% Phosphate). The data in column B resulted from washing stained swatches of material in 54° F. tap water with Cold Power.

TABLE I

| | A | | B | |
|---|---|---|---|---|
| Fabric | Stick | Aerosol | Stick | Aerosol |
| 65/35 Kodel/cotton | 53 | 66 | 60 | 46 |
| 100% polyester knit | 60 | 64 | 58 | 57 |
| 65/35 Dacron/cotton | 61 | 64 | 52 | 42 |

The data indicates that the overall performance of the stick product is essentially equal in efficacy to the aerosol product.

What is claimed is:

1. A pre-wash cleaner composition comprising the following ingredients by weight made into a solid, non-thixotropic stick: about 70% of a balanced system of paraffinic hydrocarbon solvents having an average molecular weight of about 143, and a boiling point about 300°±5° F., and nonionic detergents having the equivalent of about 3 ethylene oxide units; about 15% tallow soap; and about 15% sorbitol (70%).

2. The composition of claim 1 wherein the tallow soap contains about 15% by weight coconut soap.

3. The composition of claim 1 wherein the detergent is an ethoxylated secondary alcohol having an average of 15 carbon atoms in the hydrophobic moiety and the equivalent of 3 ethylene oxide moieties.

4. The composition of claim 1 with the addition of sodium thiosulfate.

5. The composition of claim 1 with the addition of dye and perfume.

6. The composition of claim 1 with the addition by weight of about 0.100 percent sodium thiosulfate, about 0.050 percent perfume, and about 0.004 percent C.I. 61525 dye.

7. The composition of claim 1 with the addition of sodium thiosulfate, perfume and dye.

* * * * *